US005116040A

United States Patent [19]

Sauer

[11] Patent Number: 5,116,040

[45] Date of Patent: May 26, 1992

[54] SHEET-FEEDER

[75] Inventor: Hartmut K. Sauer, Himmelstadt, Fed. Rep. of Germany

[73] Assignee: De La Rue Giori S.A., Lausanne, Switzerland

[21] Appl. No.: 669,050

[22] Filed: Mar. 14, 1991

[30] Foreign Application Priority Data

Apr. 6, 1990 [CH] Switzerland ..... 1180/90

[51] Int. Cl.[5] ..... B65H 3/12

[52] U.S. Cl. ..... 271/101; 271/106

[58] Field of Search ..... 271/93, 99-101, 271/106

[56] References Cited

U.S. PATENT DOCUMENTS

| | | | |
|---|---|---|---|
| 2,011,464 | 8/1935 | Winkler et al. | 271/101 |
| 3,278,078 | 10/1966 | Kister | 271/101 |
| 3,281,142 | 10/1966 | Treff | 271/101 |
| 3,586,316 | 6/1971 | Ehlscheid et al. | 271/101 |
| 3,650,525 | 3/1972 | Hageman et al. | 271/101 |
| 3,702,187 | 11/1972 | Hageman et al. | 271/101 |
| 3,741,535 | 6/1973 | Palkovic et al. | 271/101 |
| 3,790,163 | 2/1974 | Helm | 271/101 |
| 4,542,895 | 9/1985 | Blumle | 271/101 |

FOREIGN PATENT DOCUMENTS

| | | | |
|---|---|---|---|
| 804883 | 5/1951 | Fed. Rep. of Germany | 271/101 |
| 122641 | 7/1985 | Japan | 271/106 |

*Primary Examiner*—H. Grant Skaggs
*Assistant Examiner*—Steven M. Reiss
*Attorney, Agent, or Firm*—Kane, Dalsimer, Sullivan, Kurucz, Levy, Eisele and Richard

[57] ABSTRACT

The sheet-feeder (B), designed as a buffer store, has a magazine (24) for receiving vertically stacked sheets and having a base (26), which leaves free an edge strip (R) of the sheet stack (S). Along this edge strip there moves an endless belt (18), articulated on which are separating elements (1), provided with a curved suction surface, followed by a plurality of spacers (11). The edge strip of the lowermost sheet is bent away downward from the remaining stack as it is sucked against the curved suction surface, and has the following spacers engage over it, on which the remaining stack is supported. After passing of a separating element by the edge strip, this edge strip bears against the undersides of the spacers, bent away completely from the remaining stack. From this position, in which the endless belt (18) is briefly at a standstill, the edge strip is fed by adjustable suction heads (31) to a conveyor belt (35), the grippers (37) of which draw the lowermost sheet out from underneath the stack and transport it away.

19 Claims, 12 Drawing Sheets

S
26
34
33
21a
R"
R'
R
32
1
29
30
31
29a
R'
37
W
45
46
43
R"
44
41
VI
40
18
40a
35
VI
42
47
48
35
37

FIG. 10
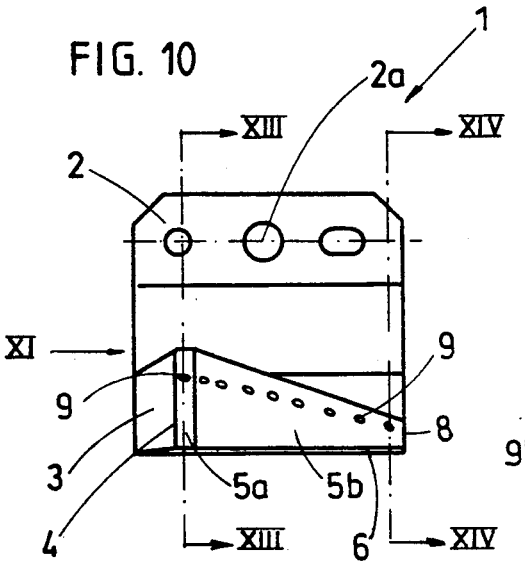
FIG. 11
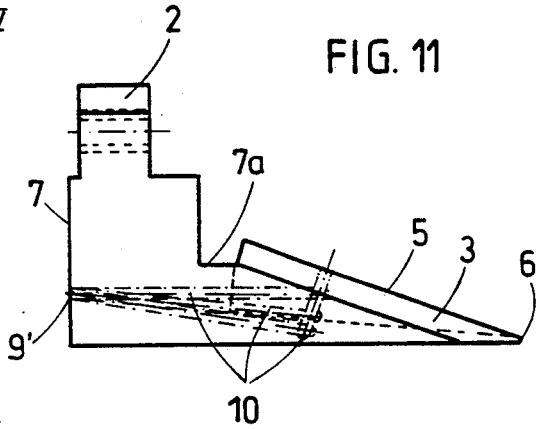
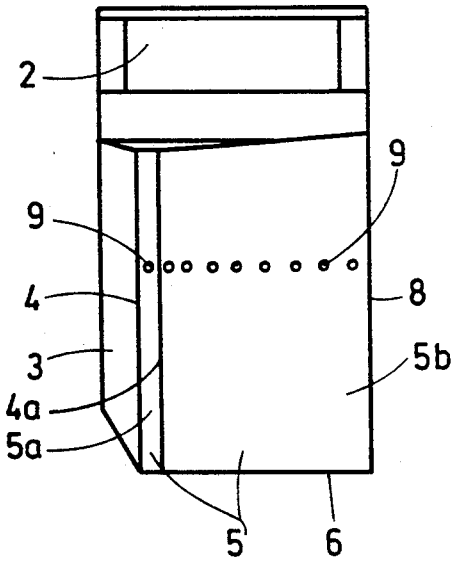
FIG. 12
FIG. 13
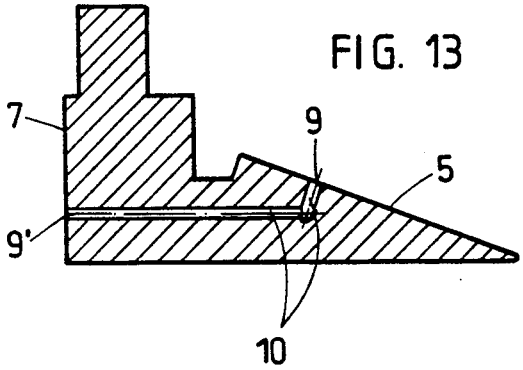
FIG. 14
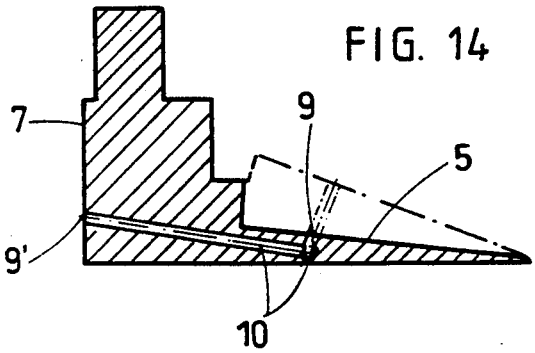

FIG. 15
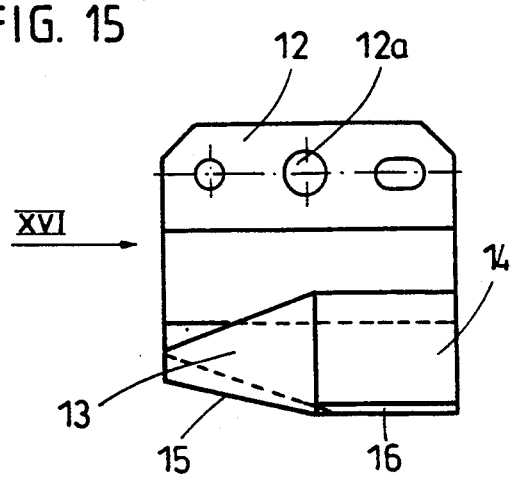
FIG. 16
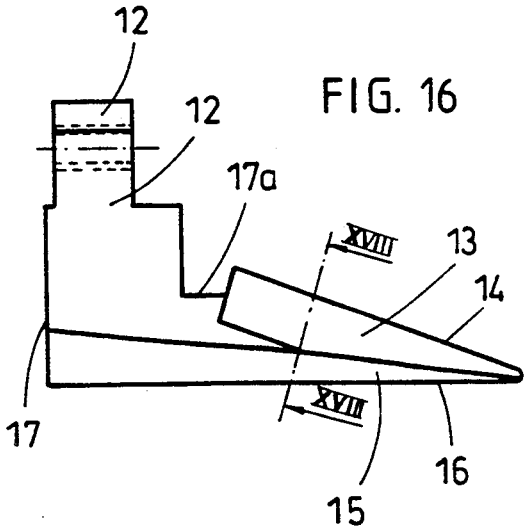
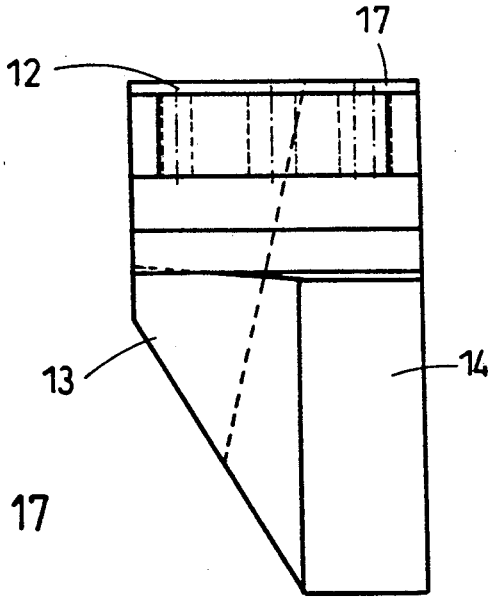
FIG. 17
FIG. 18
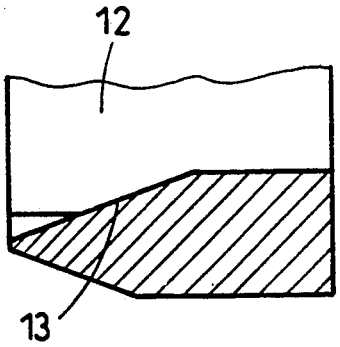

SHEET-FEEDER

FIELD OF THE INVENTION

The invention relates to a sheet-feeder comprising a magazine for receiving a sheet stack, an apparatus for individualizing the sheets with movable separating elements, which have a suction surface with suction openings, able to be connected to a suction-air source, for contacting the sheet to be individualized and separating the same from the remaining stack, and comprising a sheet conveyor for transporting away the individual sheets.

PRIOR ART

One of the most frequent errors in the operation of a sheet-feeder is that two sheets lying one on top of the other which adhere to each other are simultaneously lifted off the stack and transported further. In the case of a known sheet-feeder of the type described in the preamble of claim 1 (U.S. Pat. No. 3,885,784, DE-A,201,069), it is attempted to solve this problem by arranging that an oscillatingly driven lever which is provided with suction openings and is seated on a swivel axis oriented parallel to the plane of the sheets is initially pressed against the stack and then, after connection of the suction openings to the suction-air source, is swiveled away from the stack at such a speed that only the directly sucked-on first sheet is taken along; it is intended that the following sheet, due to its inertia, cannot follow this rapid movement, even if there happens to be a certain adhesion between the two sheets. The arrangement is made in this case in such a way that the sheets of the stack rest upright next to one another with their lower edge on the forwardly upward-inclined base of the magazine and the sheet stack is pressed by a pushing plate, bearing against its rear, forward against the mentioned lever, designed in the shape of an F. The two parallel limbs of this F-shaped lever are provided with the suction openings and form the actual separating elements. In the position lifted off the remaining stack, the sheet adhering to this lever by suction is in that plane in which it can be taken over by an endless, continuously circulating sheet conveyor. This sheet conveyor comprises an endless chain, to which suction elements are fastened at equal intervals. The suction openings on the oscillating lever and the suction elements of the sheet conveyor are connected via hoses to a distributor valve which rotates synchronously with the sheet conveyor and switches the suction effects on and off at the correct points in time. Thus, the suction openings on the oscillating lever, which is driven via a rotating cam disk, are connected to the suction-air source when the said lever assumes its rear position, in which it is pressed against the stack, and the suction effect is interrupted after the lever has reached its forward position, lifted off the stack, in which the sheet is sucked onto the suction element running past, which at this point in time is connected to the suction-air source, and is taken along.

Due to the rapidly oscillating lever and its drive, which is intended to move this lever from its rear position into its front position within 0.01 seconds, and due to the control of the suction effects acting at the lever and at the suction elements of the chain conveyor, which are to be precisely coordinated, this known sheet-feeder is of a relatively complicated construction. Since the individualizing of the sheets is reliant solely on the inertia effect, it is a question of the strengths of the adhesion of two sheets whether the rapid speed at which the first sheet is lifted off actually suffices for the inertia of the second sheet to overcome the force of adhesion. Since, furthermore, a constantly acting pushing plate is provided at the rear of the stack in the magazine, the magazine of this known sheet-feeder cannot be used an intermediate magazine or buffer store, that is to say as a magazine which is arranged between two sheet-processing apparatuses which cannot operate in a synchronous working cycle or not at the same processing speed. As known, a buffer store must be set up in such a way as to store intermediately in succession the sheets coming from the first processing apparatus and at the same time deliver individual sheets to the second processing apparatus in a working cycle corresponding to the processing speed of the latter.

SUMMARY OF THE INVENTION

The present invention is based on the object of simplifying and improving a sheet-feeder of the type described in the preamble of claim 1 with regard to the apparatus for individualizing the sheets, in such a way that the individualizing can be carried out with great reliability and, in addition, to design the entire arrangement in such a way that this sheet-feeder can be used as an intermediate magazine or buffer store.

This object is achieved according to the invention by the features specified in the characterizing part of claim 1.

Separating elements with suction surfaces of the type specified in claim 1 are admittedly already known per se in a similar form in the case of a counting apparatus for bundled notes, in particular bank notes (EP-A-0 311 567 of the same applicant), but in this case these separating elements are designed and arranged in such a way that the region of a note bearing against the suction surface of a separating element engages behind the separating element arriving thereafter and all the counted notes of a bundle in this way pass successively onto the other side of the separating elements, designed as a sliding surface. In this case as well, the bundled notes lie upright in a horizontal magazine and are pressed against the separating elements by a pushing plate bearing against the rear of the bundle. A sheet-feeder according to the present invention acting as a buffer store is therefore not suggested by this counting apparatus for notes.

The essential advantage of the sheet-feeder according to the invention is that, owing to the special curvature of the suction surface of the sliding-along separating element, the edge strip of the lowermost sheet is not just simply bent away from the stack lying above, but also experiences a torsional bending, and thereafter is held by the following spacer in the position spread away from the stack. This spacer can thereby bend the edge strip initially even further away. The edge strip of the following sheet, possibly adhering to the lower-most sheet, can admittedly be taken along initially to some extent by the bent-away edge strip, but then cannot follow the torsional deformation; rather, on account of its inherent elasticity or bending rigidity, it detaches itself from this lowermost edge strip and springs back into its initial position before the latter has experienced its maximum deflection. Thus, the resilience of a sheet to torsional deformation is utilized for individualizing. By choice of an adequately great angle of inclination of the rear edge of the suction surface of at least 10°, preferably 15° to 25°, the error rate in individualizing can be reduced to virtually zero. After the passing-by of the separating element, the spacers hold the edge strip in its lifted-away position in such a way that it can be seized directly by the grippers of a conveyor belt and transported further or can be initially removed by adjustable suction heads further from the remaining stack and thereafter taken along by a conveyor belt.

Since the sheets are loaded into the magazine at the top and removed at the underside of the magazine, the sheet-feeder according to the invention can be readily employed as a buffer store, for example between a sheet numbering machine and a cutting machine, which cuts the numbered sheets into individual notes, so-called individual blanks. Such an apparatus for processing bank note sheets is described in EP-B-167 196 of the same applicant.

Expedient developments of the invention emerge from the dependent claims.

BRIEF DESCRIPTION OF THE DRAWINGS

The invention is described in further detail by an illustrative embodiment with reference to the drawings, in which:

FIG. 10 shows a front view of a separating element, FIG. 11 shows a side view of the same in the direction of the arrow XI according to FIG. 10, FIG. 12 shows a plan view of the separating element, FIG. 13 shows a section through the separating element on XIII—XIII according to FIG. 10, FIG. 14 shows a section along XIV—XIV according to FIG. 10, FIG. 15 shows a front view of a spacer, FIG. 16 shows a side view of the same in the direction of the arrow XVI according to FIG. 15, FIG. 17 shows a plan view of the spacer, FIG. 18 shows a section along XVIII—XVIII according to FIG. 16.

DESCRIPTION OF THE PREFERRED EMBODIMENT

Figure 1:
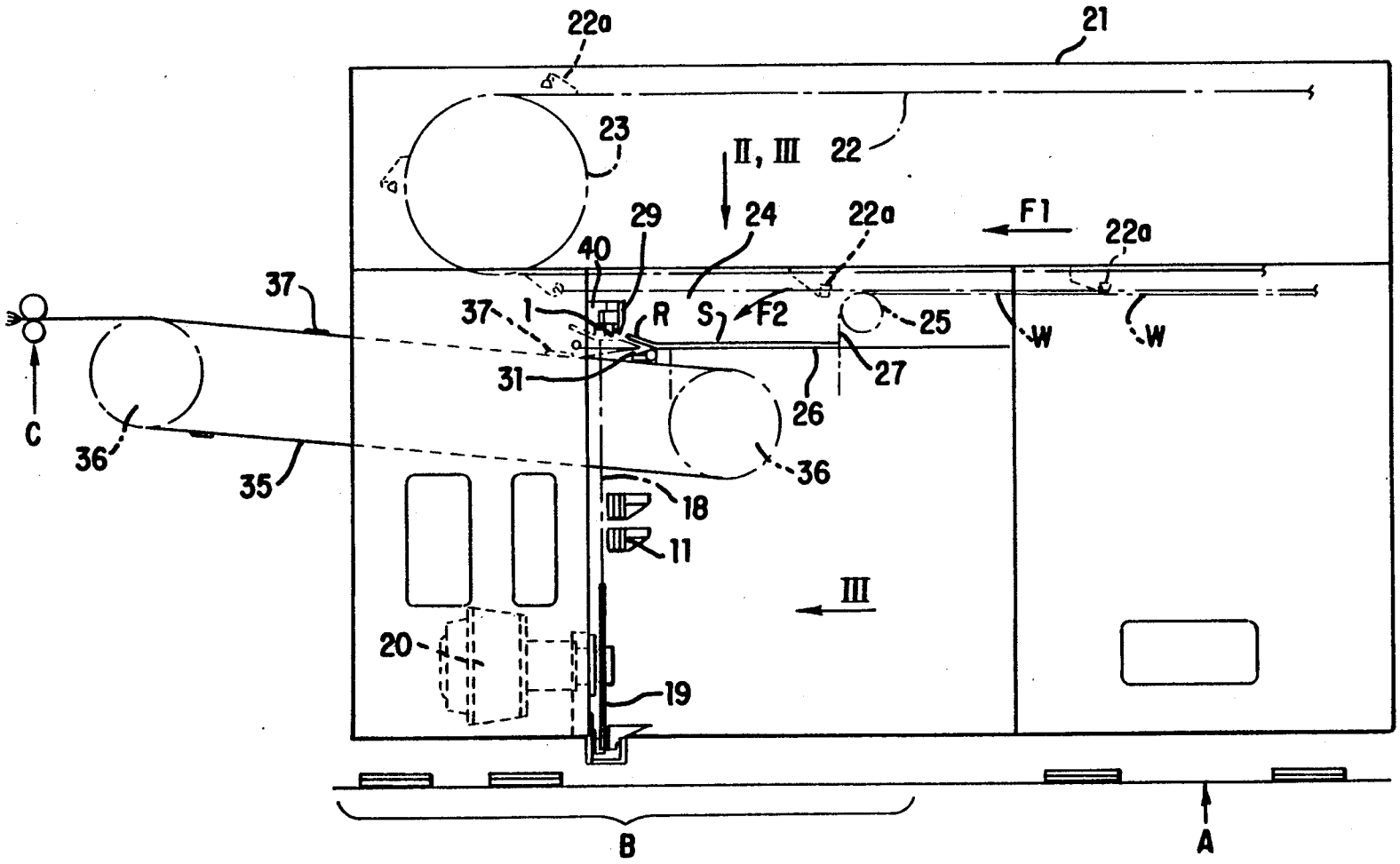
FIG. 1 shows a diagrammatic side view of the sheet-feeder according to the invention, which is arranged between two sheet-processing stations as a buffer store.

According to FIG. 1, the sheet-feeder B is installed as a buffer store between two processing stations A and C, which operate at a different working speed or with different working cycles. In the example considered, sheets provided with prints of bank notes are processed. In the station A, for example a sheet-numbering machine, the bank notes of each sheet are consecutively numbered, in the sheet-feeder B the sheets are intermediately stored, being loaded into the magazine of the sheet-feeder from above and removed from below, and in the station C, for example a cutting station only indicated diagrammatically, the sheets are cut into individual bank notes. An apparatus for processing bank note sheets with a sheet-numbering machine and a down stream cutting station is described, for example, in EP-B-167 196 of the same applicant.

Figure 2:
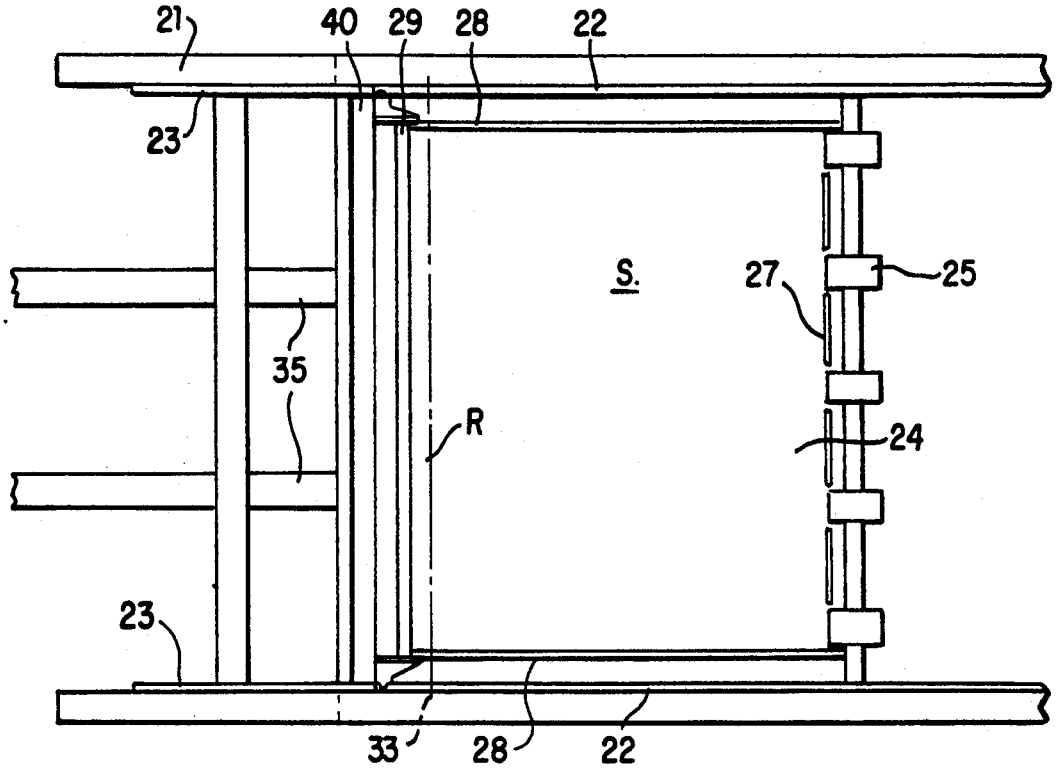
FIG. 2 shows a diagrammatic plan view of the magazine of the sheet-feeder filled with sheets, in the direction of the arrow II according to FIG. 1, the grippers of the gripper chain feeding the sheets being omitted.
Figure 3:
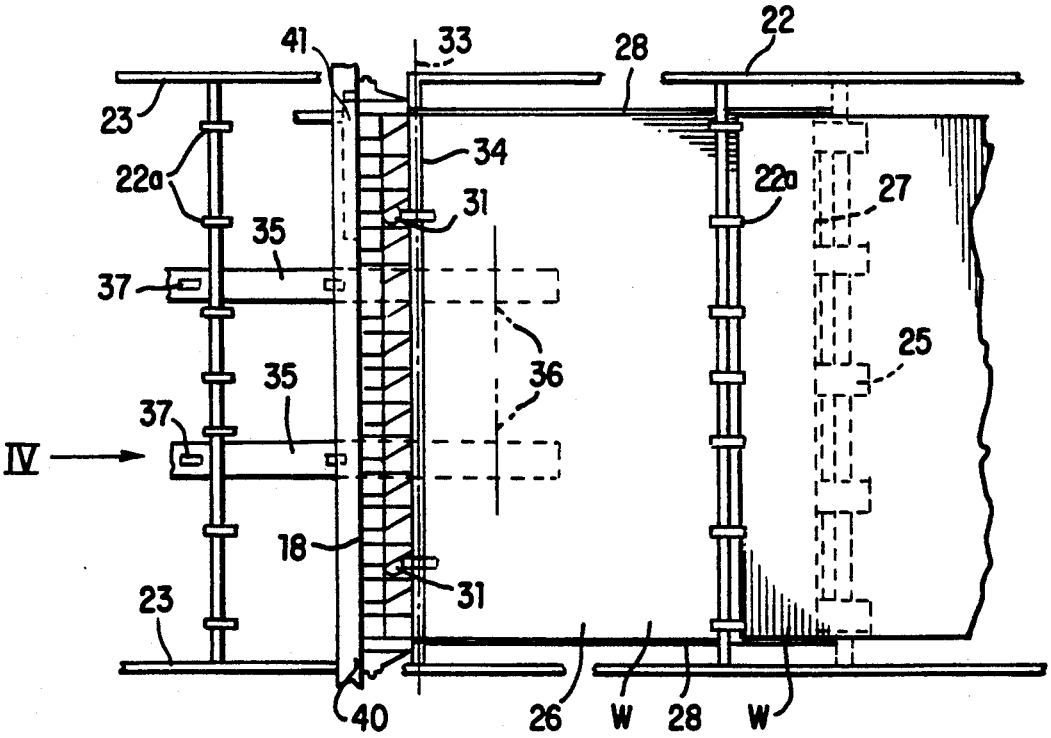
FIG. 3 shows a different plan view of the magazine in the direction of the arrow III according to FIG. 1, the guide rail lying over the spacers of the endless belt being omitted and two sheets being represented, indicated by dotted lines, one of which lies in the magazine and the following sheet has already been partially transported by the gripper chain over the magazine.
Figure 4:
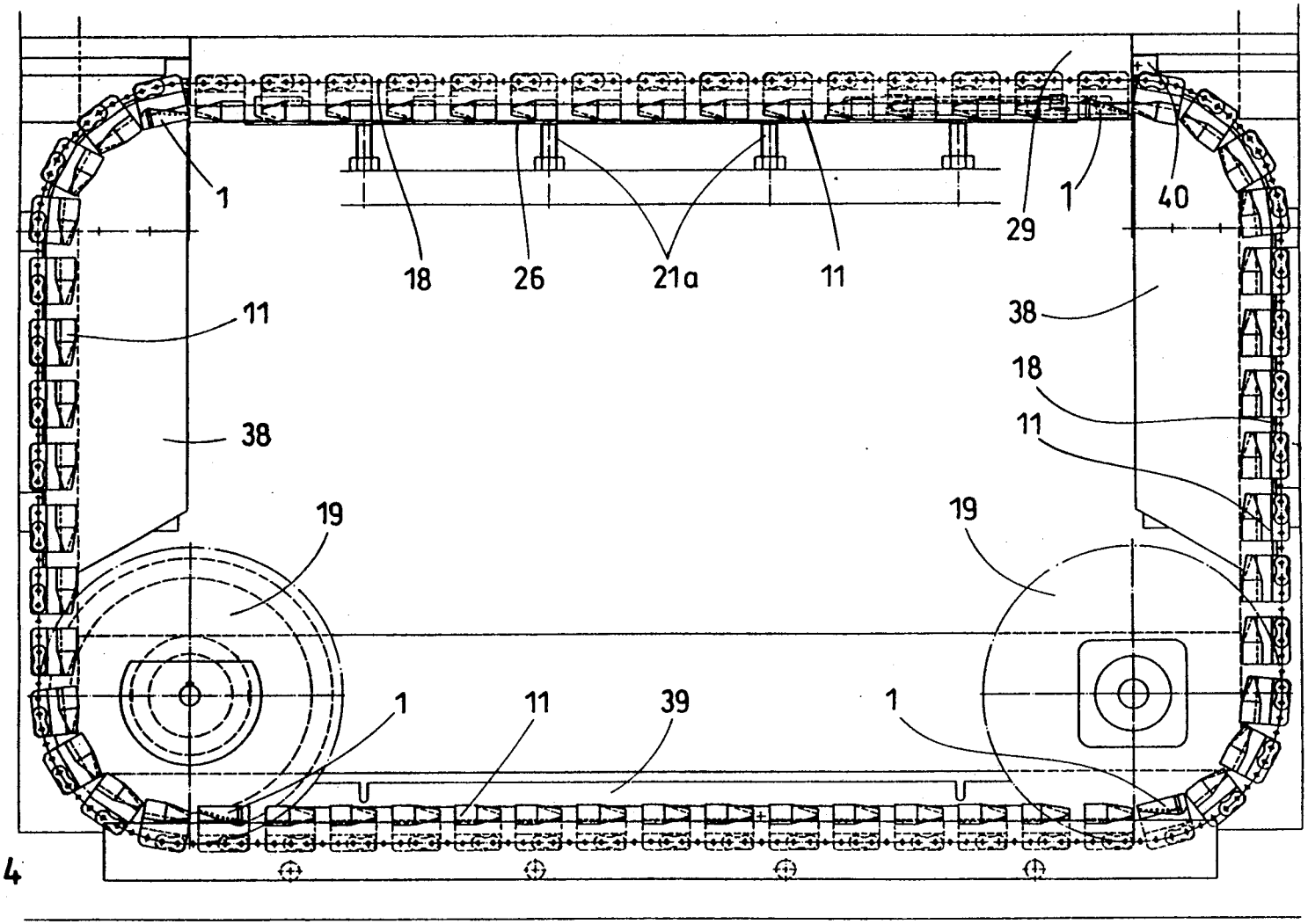
FIG. 4 shows a diagrammatic view in the direction of the arrow IV according to FIG. 3, which illustrates the endless belt in the form of an endless chain with separating elements and spacers.

The station A and the sheet-feeder B are, as shown in FIGS. 1 to 3, fitted in a common frame 21 and connected to each other by a chain gripper system, which in a customary way comprises a gripper chain 22, running over sprockets 23 and having grippers 22*a*. In FIGS. 1 to 3, the sprockets 23 are shown at one end of the gripper chain. The numbered sheets W are conveyed individually with the aid of this chain gripper system from the station A in the direction of the arrow F1 to the sheet-feeder B, where they drop from above in the direction of the arrow F2 into the open magazine 24 and form there a sheet stack S. Rollers 25 facilitate the depositing of the sheets in the magazine 24. The magazine 24 has a base 26, which is fastened on supports 21*a* (FIG. 7), extends only over a part of the stack underside and leaves free a front edge strip R, in the direction of arrival of the sheets, a rear wall 27, two side walls 28 (FIGS. 2 and 3) and a front wall, which is formed by a guide rail 29, explained later. Along the edge strip, that is to say perpendicular to the plane of the drawing according to FIG. 1, there runs an endless belt in the form of an endless chain 18, the path of movement of which is, as FIG. 4 shows, substantially rectangular. Fastened jointedly to this chain 18 are separating elements 1 and spacers 11, described in further detail later, on the upwardly inclined upper sides of which the edge strips R of the sheet stack S rest, which are therefore correspondingly bent obliquely upward. Serving for guidance of the chain 18 are two sprockets 19, one of which is driven by a motor 20 (FIG. 1), lateral guiding rails 38 (FIG. 4), a lower guiding rail 39 and an upper, straight guiding bar 40, running along the edge strips R of the sheet stack S. The arrangement is made in such a way that, when sliding on the underside of the sheet stack S, as described later, a separating element 1 bends away the edge strip of the lowermost sheet from the remaining stack and the following spacers hold the bent-away edge strip positioned in such a way in a transfer position that the sheet can be transported away to the station C by a sheet conveyor.

In the example considered, this sheet conveyor comprises two intermittently movable suction heads 31, each on a lever 32 which is able to swivel about an axis 33 (FIGS. 3 and 7), and an endless conveyor belt 35, running over deflection rollers 36 and having grippers 37 (FIG. 1). The suction heads 31 draw a bent-away edge strip so far down into the effective range of the conveyor belt 35 that the grippers 37 can seize this edge strip, then draw the sheet out from underneath the stack S and transport it to the station C. For this purpose, the suction heads 31 are connected in their upper position, in which they bear against a bent-away edge strip, to a suction-air source (not shown), so that this edge strip is sucked onto them, and after reaching their lower position, in which the sheet is taken over by grippers 37, switched off again from the suction-air source. The individualizing of the sheets is explained in still more precise detail later with reference to FIGS. 7 to 7*c*.

As shown in FIG. 4, the separating elements 1 articulated on the chain 18 are at a distance from one another which is greater than the dimension of the stack S in the longitudinal direction of the edge strips R. Articulated between two separating elements 1 there are spacers 11, evenly distributed at a small distance from one another, in the example considered fourteen spacers 11 in each case. The number of these spacers depends of course on the dimension of the largest sheet to be processed. In principle, with small sheets at least two spacers 11 behind each separating element 1 suffice, the distance between each of which and from the respectively neighboring separating element 1 is smaller than half the length of the edge strip, so that in the transfer position of a sheet there are nothing but spacers underneath the edge strip.

Figure 8:
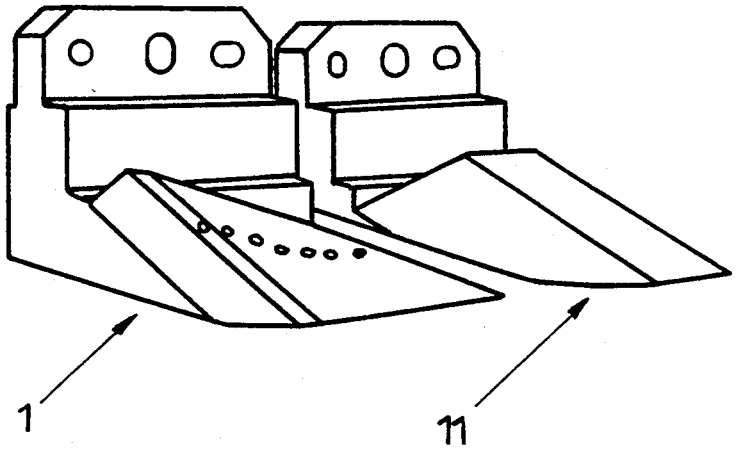
FIG. 8 shows a perspective view of a separating element and of a spacer lying behind it, seen obliquely from the front.
Figure 9:
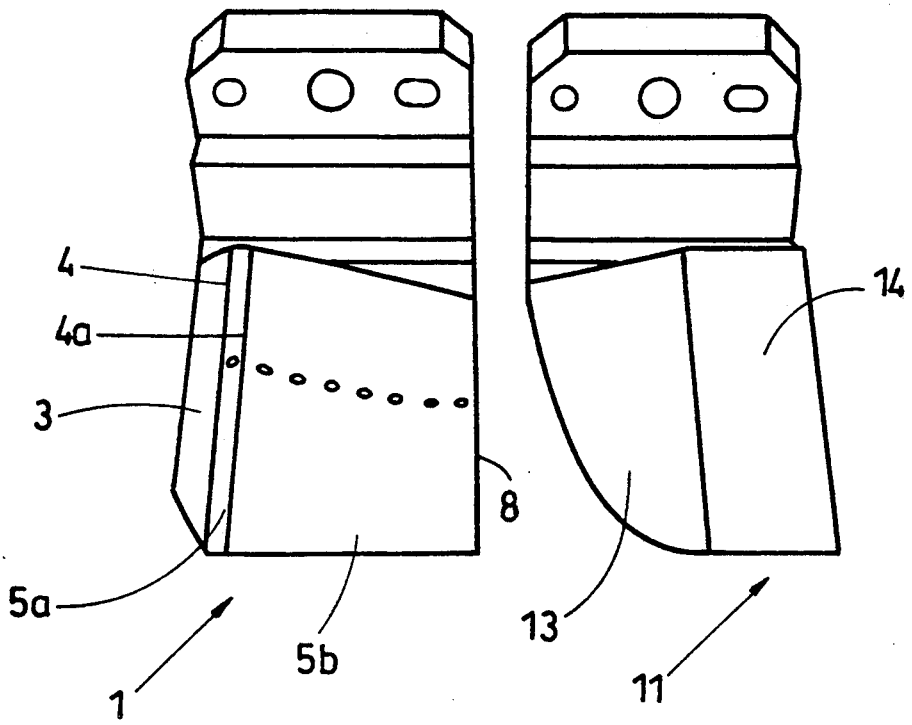
FIG. 9 shows another perspective view of these two parts, seen from above.

FIGS. 8 and 9 show two different perspective representations of a separating element 1 and of a spacer 11. The separating element 1 has, as can be seen in particular from FIGS. 10 to 14, a fastening flange 2 with fastening holes 2*a*, which serve for jointed fastening to the chain 18, a flat rear 7 and a part projecting on the other side. The upper side of this part has a continuous groove 7*a*, parallel to the rear 7, and adjoining said groove a surface region engaging underneath the edge strip and having three sections, to be precise a front ramp 3, in the direction of movement of the separating element, and a suction surface 5, formed by two sections 5*a*, 5*b* and having suction openings 9. The front edge 4 of the suction surface is initially adjoined by a flat surface section 5*a*, on which there is in the example considered only one suction opening 9, followed by a curved surface section 5*b*, which has eight suction openings 9. When the separating element slides along on the underside of an edge strip, the front edge 4 and the flat surface section 5*a* are oriented parallel to the latter, and the flat surface section 5*a* bears against this edge strip. In the region of the curved surface section 5*b*, the suction surface is curved away from the plane of the edge strip in the direction of its rear edge 8 in such a way that its angle of inclination with respect to this plane increases constantly. The maximum angle of inclination, i.e. the angle between the plane of the surface section 5*a* and the rear edge 8, in this case lies between 10° and 30°, preferably between 15° and 25°; in the example considered, it is about 20° and corresponds to the angle by which the edge strips of the stack are bent upward in the magazine when resting on the spacers. The front edge 4*a* of the curved surface section 5*b* and the side edge 6 of the suction surface lie in a common plane, parallel to the edge strip, so that, during sliding along of the separating element, this edge strip is increasingly bent away downward from the remaining stack as it is sucked against the curved suction surface.

Figure 6:
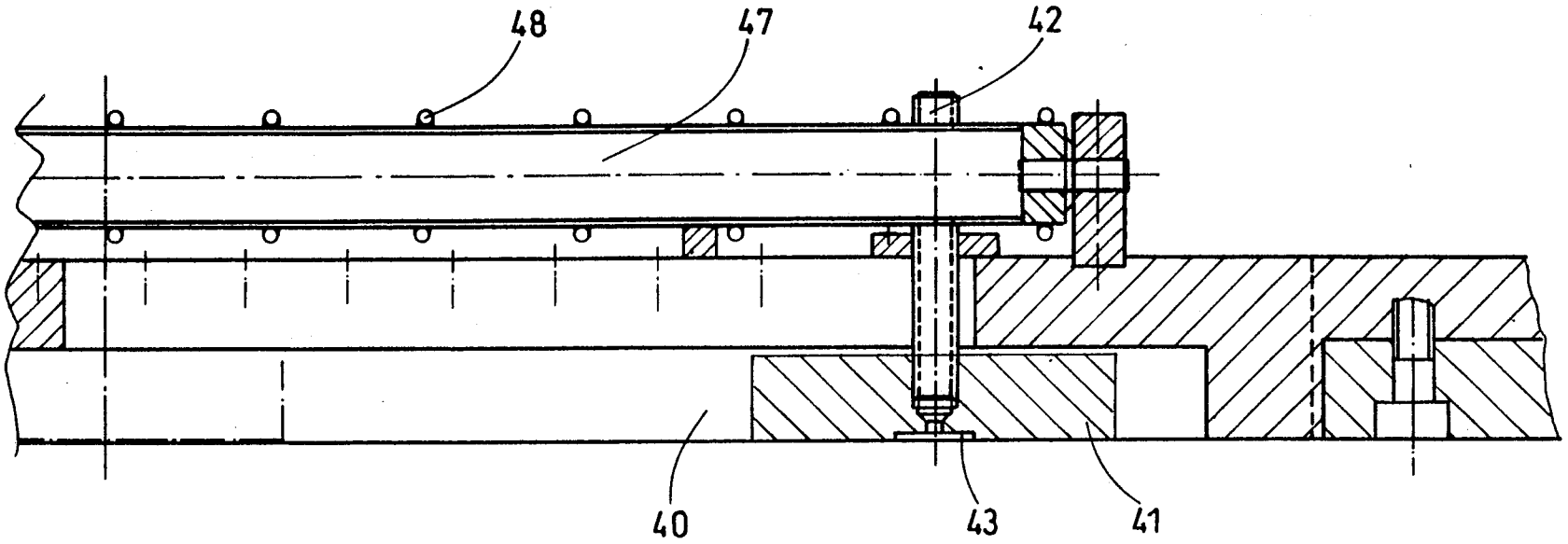
FIG. 6 shows a partial section along VI—VI according to FIG. 7, which represents the suction bar inserted in the guiding bar as well as the guiding roller for the individualized, transported-away sheets.

To generate the suction effect, the suction openings 9 are briefly connected to a suction-air source as soon as the separating element 1 has come into contact by its flat surface section 5*a* with the edge strip of the lowermost sheet of the stack. For this purpose, the suction openings 9 are provided by inner channels 10 with openings 9' opening out on the rear 7 of the separating element. The rear 7 slides within the chain guidance along a suction bar (FIG. 7), in which a small tube 42, connected to a suction-air line, opens out in a slot 43 (FIG. 6). In the example considered, this slot 43 extends over three mutually adjacent openings 9', so that in each case only three suction openings 9 suck the edge strip onto the suction bar during passing of the separating element. Depending on the length of the suction surface, for example 6 to 12 suction openings 9 may be provided, of which in each case 2 to 5 exert a suction effect.

The spacer 11 represented in FIGS. 15 to 18 likewise has a fastening flange 12 with fastening openings 12*a*, a flat rear 17 and a transversely projecting part, which in turn has an upper groove 17*a*, parallel to the rear, and a region engaging underneath the stack. The upper side of this region comprises an upper ramp 13 and an adjoining flat resting surface 14 and its underside comprises a lower ramp 15 and an adjoining flat positioning surface 16. The upper ramp 13 and the lower ramp 15 form a forwardly tapering wedge, and their front edges are, as FIG. 17 shows, beveled in plan view. The resting surface 14 is parallel to the edge strip of the sheet stack.

If a separating element 1 and a following spacer 11, in the direction of movement of the chain, are considered, the plane in which the lower ramp 15 lies runs parallel to the rear edge 8 of the separating element 1 and at a small distance above this edge. This lower ramp 15 therefore engages over the edge strip of a sheet sucked on by the suction surface 5 of the preceding separating element 1, which strip comes into contact with the lower positioning surface 16 of the spacers, and consequently completes the separation of the edge strip from the remaining stack, which supports itself during further moving of the spacers on their resting surfaces 14.

Figure 5:
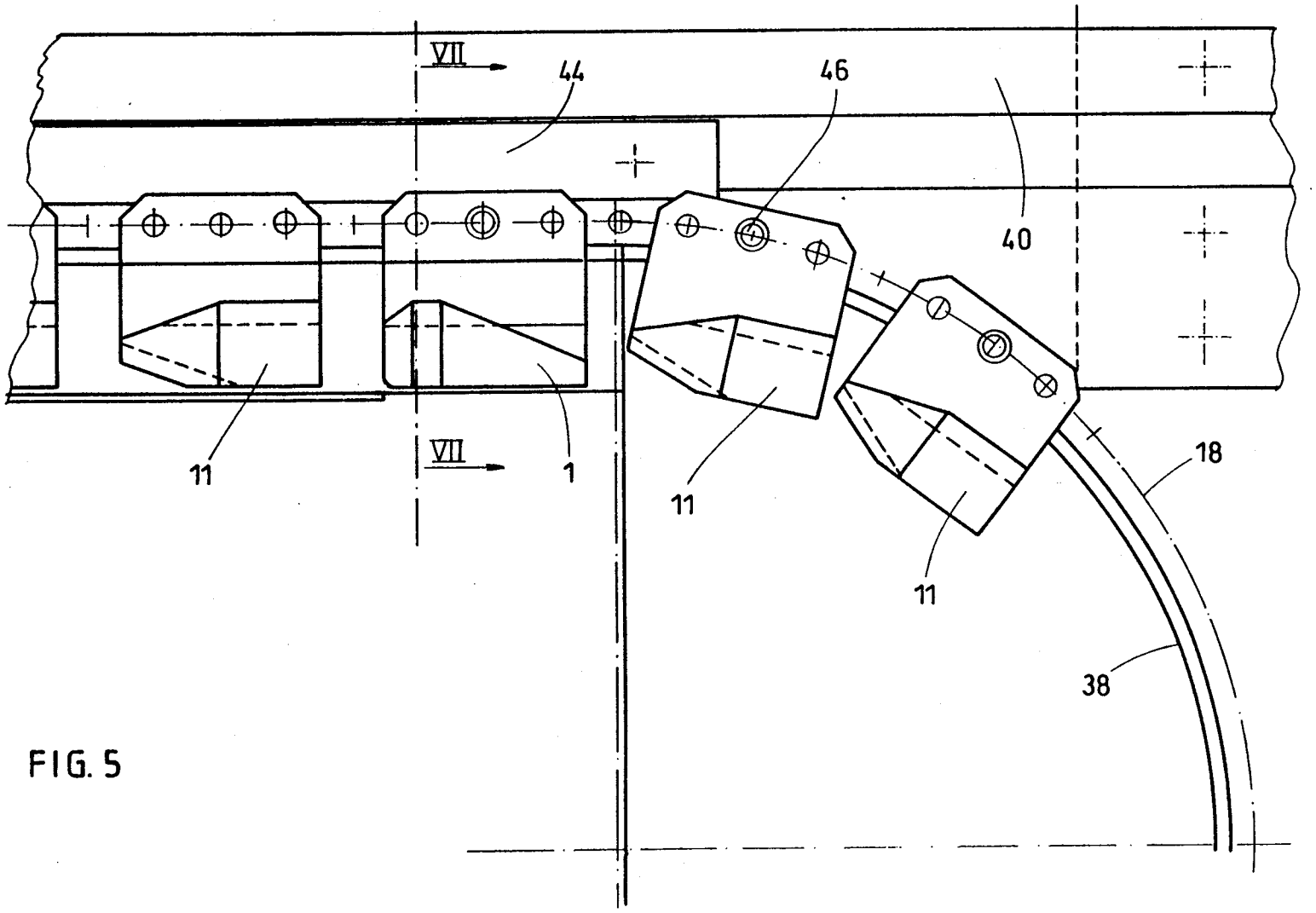
FIG. 5 shows an enlarged representation of the right-hand, upper chain section according to FIG. 4 with the guiding bar for the chain, the guide rail being omitted.
Figures 7, 7A:
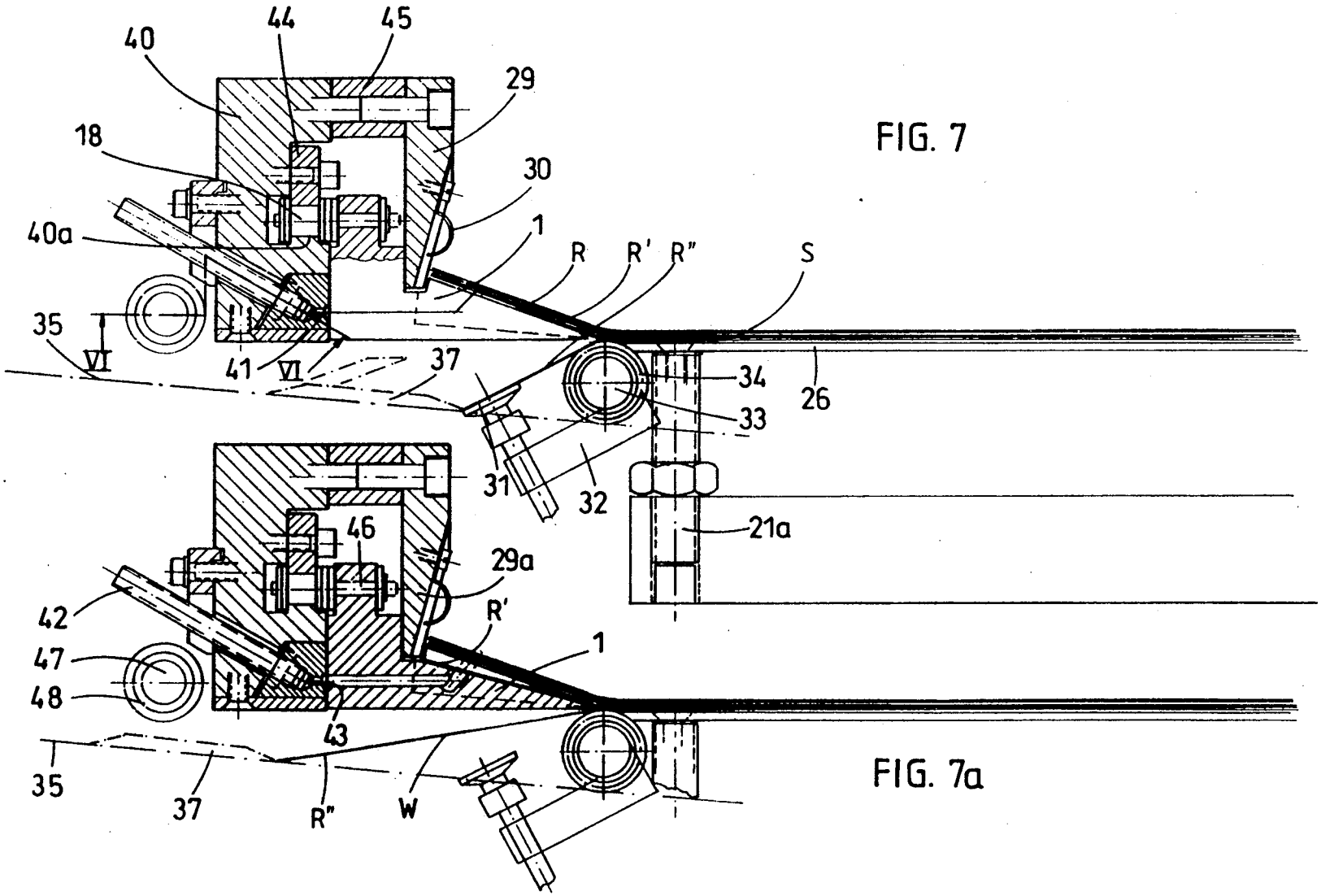
FIG. 7 shows a section along VII—VII according to FIG. 5 with a separating element in that position in which it is just beginning to engage under the edge strip of the sheet stack.
FIG. 7*a* shows a section at the same place on the guiding bar at a slightly later point in time, at which the slightly advanced separating element is now connected to the suction line and sucks onto it the edge strip of the lowermost sheet.

FIGS. 5, 7, 7*a* show the guiding bar 40 for the chain 18, which is installed next to the magazine 24 along the edge strip R of the stack and runs in a guiding groove, which is bounded underneath by a surface 40*a* of the guiding bar 40 and above by an auxiliary bar 44 fastened to said guiding bar. The separating elements 1 and spacers 11, jointedly fastened to the chain 18 by means of bolts 46, are for their part guided in their movement along the edge strip by the guide rail 29, which is fastened by means of an intermediate bar 45 to the upper region of the guiding bar 40. The guide rail 29 engages with its downwardly tapering end 29*a* in the upper groove 7*a* and 17*a*, respectively, of the separating elements and spacers, the vertical bounding surfaces of these grooves being guided on the flat inner surface of the guide rail 29 and the flat rears 7 and 17, respectively, of the separating elements and the spacers sliding on the inside of the guiding bar 40.

At the beginning of the edge strip, in relation to the direction of movement of the chain 18, the suction bar 41 is inserted in the lower part of the guiding bar 40, as FIG. 6 also shows. The slot 43 of the suction bar 41 is connected to the small tube 42 which passes through the guiding bar and is for its part in connection with the suction line (not shown) to the suction-air source. Consequently, during passing of a separating element 1, three suction openings 9 are in each case connected one after the other, beginning with the suction opening on the flat surface section 5*a* of the suction surface 5, to the suction-air source via the openings 9' and the channels 10.

The outer surface of the guide bar 29 at the same time forms the front wall of the magazine 24, against which the sheets dropping into the magazine strike with their front edge. In so doing, the front edges engage underneath a bent retaining spring 30, which is fastened to the guide rail 29 and prevents an upward slipping of the sheet front edges during dropping into the magazine.

Figures 7B, 7C:
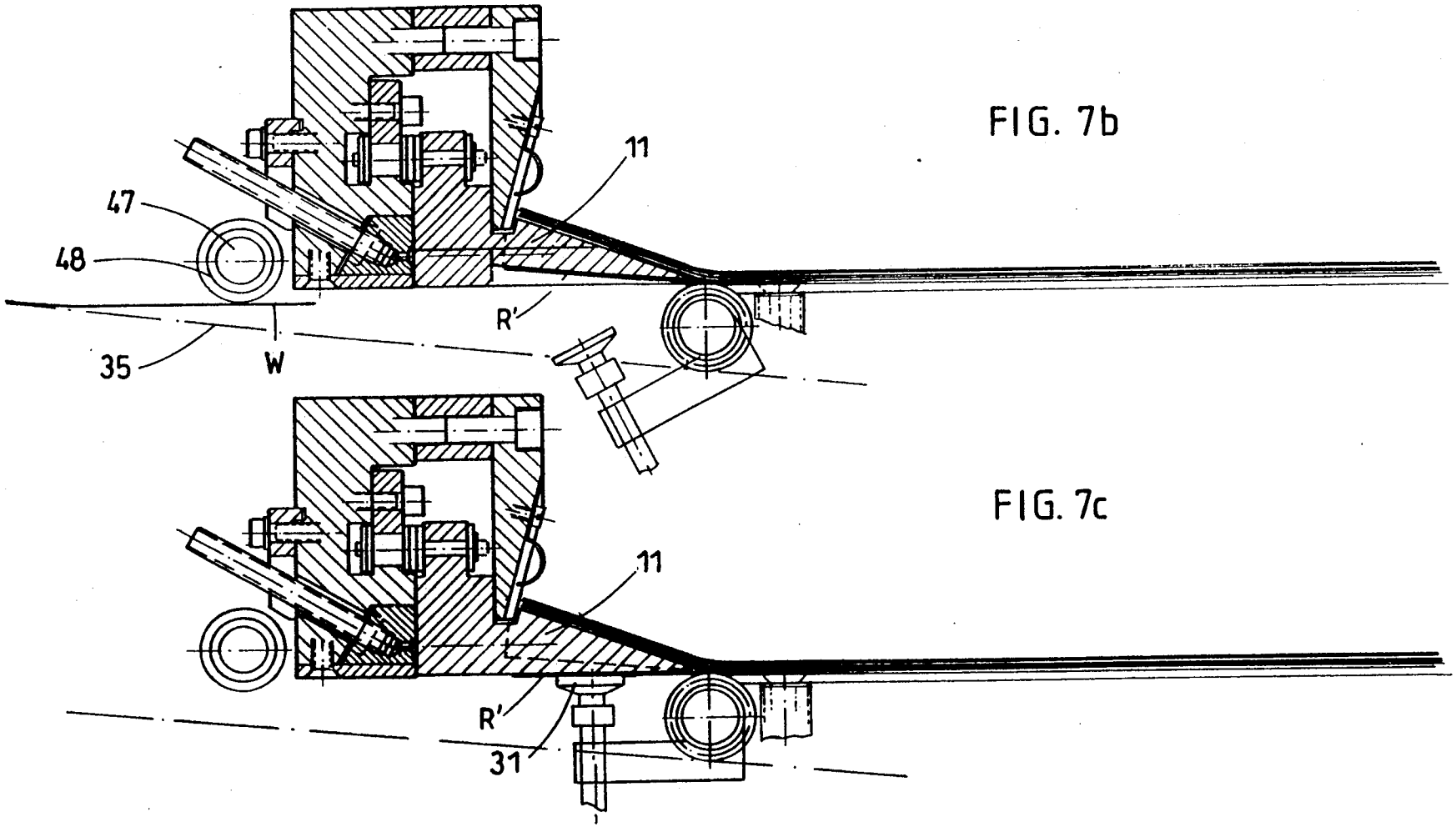
FIG. 7*b* shows a section at a later point in time at the same place, at which there is now a spacer which separates the edge strip of the sheet from the remaining stack.
FIG. 7*c* shows a section at the same place at a point in time at which the bent-away edge strip is in the transfer position on the underside of the spacer and is taken over by the suction heads.

The operation of individualizing is summarized with reference to FIGS. 7 to 7*c*:

FIG. 7 shows the instant at which a separating element 1 is just entering underneath the stack and the flat surface section 5*a* is coming into contact with the lowermost edge strip R'. The edge strip R" of the preceding sheet had, immediately before, when there were only spacers 11 underneath the stack, been bent downward by the suction heads 31 now in their lower position and is now being taken over by closing grippers 37 of the conveyor belt 35; at the same time, the suction heads 31 are switched off from the suction air. FIG. 7*a* shows the immediately following phase of the edge strip R' being sucked by the suction surface 5 of the separating element 1 onto it while the latter slides past the slot 43 of the suction bar 41. At the same time, the grippers 37 draw the previously individualized sheet W out from under the roller 34, seated on the spindle 33, and later being guided during further transport by an upper roller 47, which is provided with o-rings 48, as indicated in FIG. 7*b*. It is also possible to dispense with the rollers 34 and 47.

FIG. 7*b* shows the subsequent separating operation, in which the edge strip R' sucked onto the separating element and bent away has the following spacer 11 engage over it and is separated further from the remaining stack by the lower ramp 15 of said following spacer.

FIG. 7*c* shows the positioning phase, in which the edge strip R' is separated completely from the remaining stack and bears against the lower positioning surfaces 16 of the spacers 11. In this transfer position, there is no separating element 11 underneath the stack, which supports itself on the resting surfaces 14 of the spacers 11, and the edge strip R' can now be sucked onto the suction heads 31, which have been swiveled into their upper position and connected to the suction-air source. In this transfer position, the sheet assumes its flat shape. As the process continues, the edge strip R' is swung downward by the suction heads and, as explained for the edge strip R" and the sheet W in FIGS. 17, 17*a*, taken over by the grippers 37 of the conveyor belt 35, which transports the sheet away through the inner space of the endless chain 18.

In the mentioned transfer position, which is represented in FIG. 7*c*, the chain 18 is briefly at a standstill, for example for a few tenths of a second, so that the suction heads 31 can reliably seize the lower-most sheet. During this standstill of the chain, two spacers 11 may be located on a level with the two suction heads 31, so that in the upper sucking position of the suction heads the edge strip is pressed against the positioning surfaces of these spacers. This position of the chain is not necessary, however, the two suction heads may also be located between two spacers during sucking of the edge strip.

It has been found that up to 4000 sheets per hour can be individualized with the sheet-feeder described, which meets modern requirements for the working speed of numbering machines and sheet-cutting machines. Preferably, the stack in the magazine should always have between about 4 and 40 sheets.

The distance of the spacers 11 from the separating elements 1 and from one another is preferably less than the length, in particular than half the length, of the suction surface 5 of a separating element, so that the bent-away edge is held over its entire length well positioned in the transfer position. In the example considered, this distance is slightly more than a third of the length of the suction surface or just about a third of the length of a separating element or of a spacer.

It is achieved by the special design of the curved suction surface 5 of the separating elements that the sucked-on edge strip of a sheet is not only bent around the side edge 6 of the suction surface, but at the same time is twisted about an imaginary straight line lying parallel to this side edge 6. Since the resilient force of paper, in particular of bank note paper, is generally greater in the case of a torsional deformation than in the case of a straightforward bending deformation, it is ensured that an edge strip of the next sheet which may be taken along by the edge strip just being sucked on, the former possibly adhering slightly to the sucked-on edge strip, resumes with certainty its initial position before the edge strip of the sheet to be individualized has reached its maximum torsional deformation. The edge strip of the following sheet possibly taken along namely cannot follow this deformation due to its inherent elasticity. It has been possible to confirm this extremely rapidly occurring procedure with the aid of stroboscope exposures.

In the case of the sheet-feeder described above, the flat surface section 5*a* of the suction surface of the separating elements 1 and the flat resting surface 14 of the spacers 11 are inclined in relation to the base 26 of the magazine 24 by about 20°, so that the edge strips R in the magazine 24 assume a correspondingly inclined position and, after the individualizing, lie precisely horizontal in the transfer position, that is to say the individualized sheet assumes its flat shape.

Figure 19:
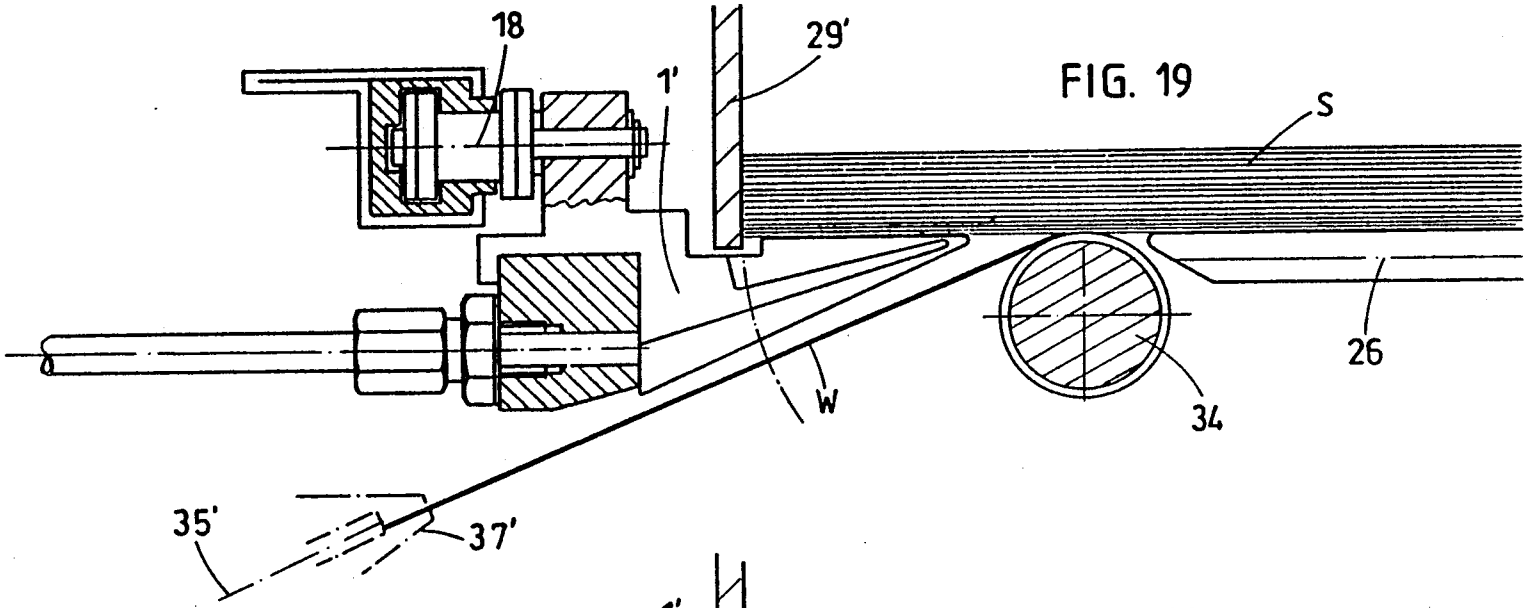
FIG. 19 shows a sectional representation corresponding to FIG. 7 of a modified embodiment of a sheet-feeder with differently oriented separating elements and spacers, different chain guidance and with direct transfer of an individualized sheet to a chain gripper.
Figure 19A:
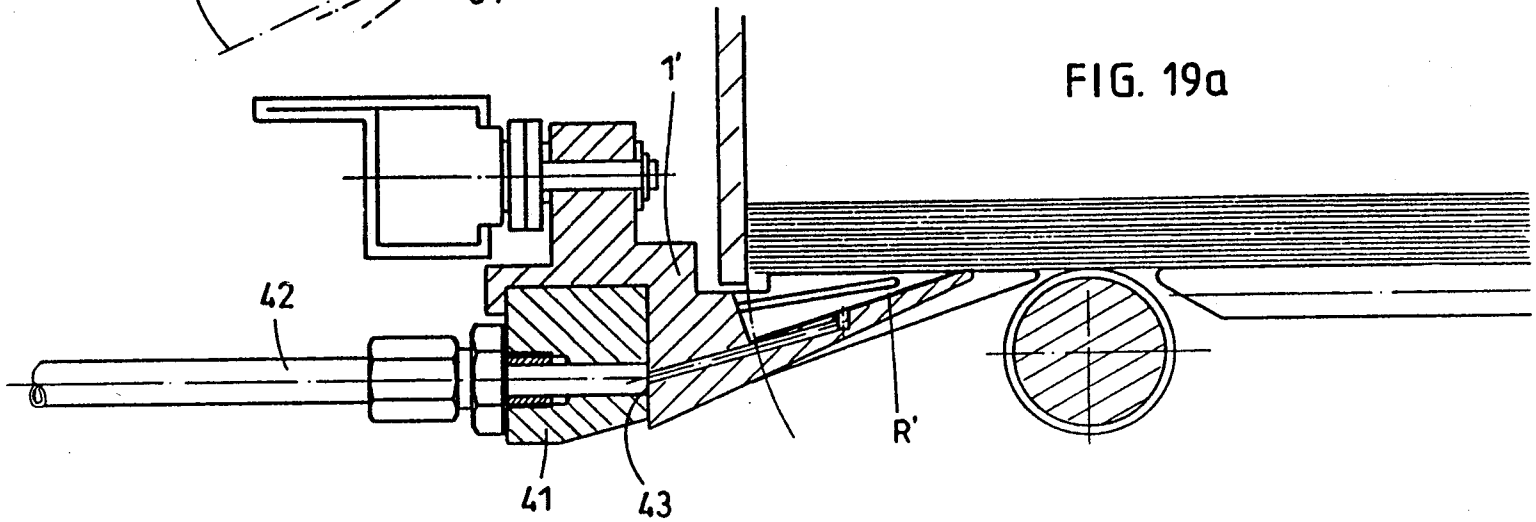
FIGS. 19*a*, 19*b* and 19*c* show representations corresponding to FIGS. 7*a*, 7*b* and 7*c*, respectively, of successive working positions of the embodiment according to FIG. 19 during the individualizing of a sheet.
Figure 19B:
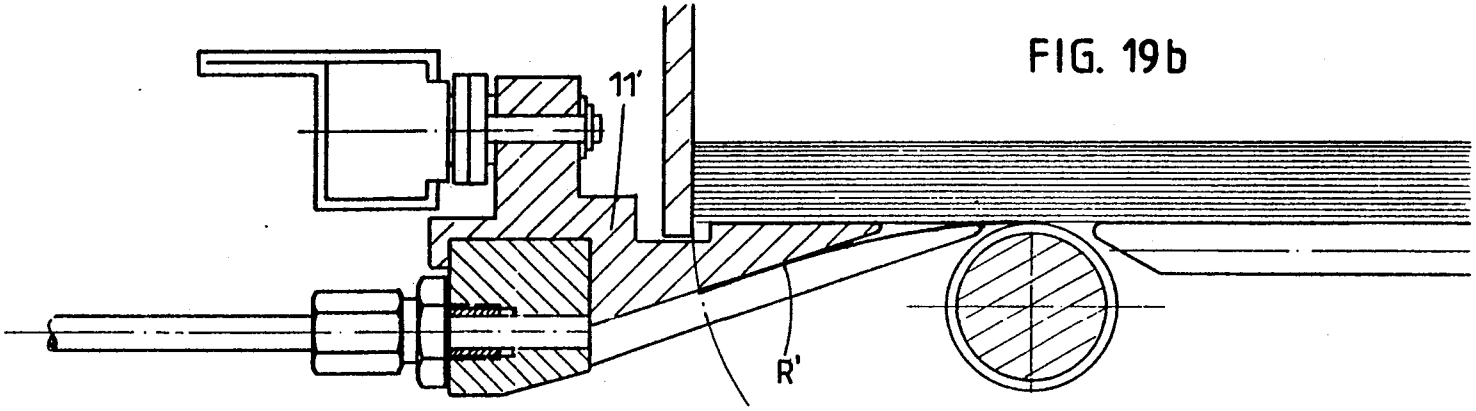
Figure 19C:
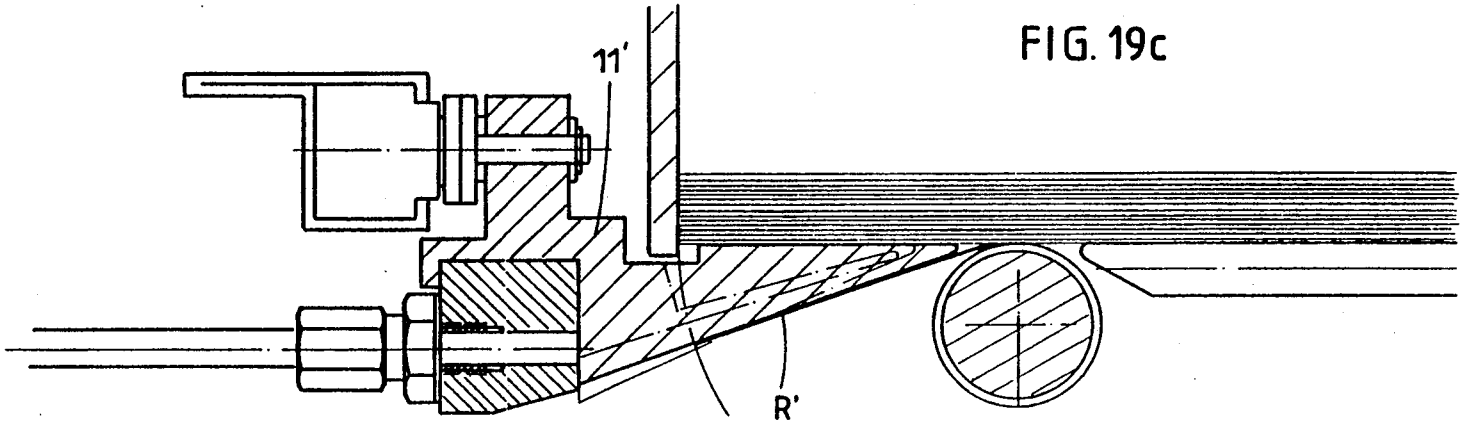

However, in accordance with a modified embodiment according to FIGS. 19 to 19*c*, the separating elements 1' and the spacers 11' may also be designed in such a way that the flat surface sections 5*a* of the suction surface of the separating elements and the resting surfaces 14 of the spacers lie in a common plane with the magazine base 26, so that all the sheets in the magazine lie flat one on top of the other. For individualizing, the lowermost edge strip R' is then bent away downward, in precisely the same way as described above, out of its horizontal position in accordance with the curvature of the suction surface of the separating element 1, so that, in its transfer position (FIG. 19*c*), it is inclined downward in relation to the remainder of the sheet. FIGS. 19 to 19*c* correspond to the phases represented in FIGS. 7 to 7*c* and are therefore not explained again. The same parts are provided with the same reference symbols.

As a departure from the sheet-feeder described above with reference to FIGS. 1 to 18, in the case of the modification according to FIGS. 19 to 19*c*, the individualized sheets W are taken over, as indicated diagrammatically in FIG. 19, directly by grippers 37' of a conveyor belt 35', dispensing with suction heads, which conveyor belt runs on a level with the intermediate spaces between two spacers 11' in such a way that an edge strip R' bearing against the positioning surfaces of the spacers 11 in the transfer position can be seized by the grippers 37'. In the representation according to FIG. 19, the individualized sheet W has been drawn out a little from underneath the stack by the grippers 37'. Furthermore, the sheet-feeder according to FIGS. 19 to 19*c* has a differently designed chain guidance; the front edges of the stacked sheets bear against a front wall 29' of the magazine, and guidance of the slightly differently designed separating elements 1' and spacers 11' takes place directly on the suction bar 41, which has the function of a guide rail.

The invention is not restricted to the examples described but allows manifold variants regarding the design and arrangement of the parts as well as the number of spacers used.

I claim:

1. Sheet-feeder, comprising a magazine (24) for receiving a sheet stack (S), an apparatus for individualizing the sheets with movable separating elements (1), which have a suction surface (5) with suction openings (9), able to be connected to a suction-air source, for contacting the sheet to be individualized and separating the same from the remaining stack, and comprising a sheet conveyor for transporting away the individual sheets, characterized in that the magazine (24) is set out for receiving sheets lying substantially vertically one on top of the other and has a base (26), which extends only over a part of the magazine underside and leaves free an edge strip (R) of the stack, in that a plurality of separating elements (1), provided with a curved suction surface (5), are fastened to an endless belt (18), able to move past in front of the free edge strip, at a distance from one another which is greater than the length of the edge strip (R), in that the front edge (4), in the direction of movement, of the suction surface (5) is oriented parallel to the plane of the edge strip and the suction surface is curved away from this plane in the direction of its rear edge (7) in such a way that its angle of inclination with respect to this plane increases constantly, so that the edge strip (R') of the lowermost sheet is increasingly bent away downward from the remaining stack as it is sucked against this curved suction surface, in that at least two spacers (11) are fastened to the endless belt (18) downstream of each separating element (1), in the direction of movement, the distance of which spacers from one another and from the respectively neighboring separating element (1) is less than half the length of the edge strip and which spacers run through between the bent-away edge strip (R') of the lowermost sheet and the remaining stack, supporting the latter, and in that, after complete separation of an edge strip (R') in a position of the endless belt (18) in which there are only spacers (11) underneath the sheet stack (S), the individualized sheet (W) assumes its transfer position and is taken over by the sheet conveyor.

2. Sheet-feeder according to claim 1, characterized in that the endless belt (18) is intermittently movable and in the position mentioned is temporarily at a standstill.

3. Sheet-feeder according to claim 1, characterized in that each separating element (1) has on its upper side in the front section in the direction of movement a rising front ramp (3), reaching up to the mentioned front edge (4), has thereafter as front section of the suction surface (5) a flat surface section (5*a*) and, behind that, a curved surface section (5*b*) and in that the flat surface section (5*a*) is oriented parallel to the edge strip and is provided with at least one suction opening (9).

4. Sheet-feeder according to claim 3, characterized in that a side edge (6) facing the base (26) of the magazine (24) and the front edge (4) of the curved surface section (5*b*) of the suction surface (5) of each separating element (1) lie in a common plane.

5. Sheet-feeder according to claim 1, characterized in that the maximum angle of inclination which the rear edge (8), in the direction of movement, of the suction surface (5) includes with the plane of the edge strip is between 10° and 30°.

6. Sheet-feeder according to claim 1, characterized in that each spacer (11) has a front wedge-shaped region, in the direction of movement, which tapers toward the front and is bounded by an upper ramp (13) and by a lower ramp (15), the plane in which the lower ramp (15) lies in a spacer (11) following a separating element (1) running parallel to and is a small distance above the rear edge (8) of the curved suction surface (5) of this separating element (1), and in that the mentioned, wedge-shaped region is adjoined by a region bounded by an upper, flat resting surface (14) and by a lower, flat positioning surface (16), the resting surfaces (14) serving to support the edge strip of the stack (S) located in the magazine (24) and the positioning surfaces (16) serving to bring into contact an edge strip (R') bent away from this stack.

7. Sheet-feeder according to claim 1, characterized in that the distance between a separating element (1) and the following spacer (11) is less than the length of the suction surface (5).

8. Sheet-feeder according to claim 1, characterized in that the endless belt (18) runs alongside the magazine side neighboring the edge strip and the separating elements (1) and also the spacers (11) engage under the lower edge of this magazine side, and in that the sheet conveyor transports away the individualized sheet (W) perpendicularly to the direction of movement of the endless belt (18), through the inner space surrounded by the latter.

9. Sheet-feeder according to claim 8, characterized in that the mentioned magazine side is formed by the flat outer surface of a guide rail (29), which guides the separating elements (1) and the spacers (11) along their path running along the edge strip.

10. Sheet-feeder according to claim 1, characterized in that the sheet conveyor is a conveyor belt (35) with grippers (37), which seize the edge strip (R'), bent away from the remaining stack, in the transfer position.

11. Sheet-feeder according to claim 1, characterized in that the sheet conveyor has adjustable suction heads (31), which are movable between an upper position, in which they suck onto them the bent-away edge strip (R') in the transfer position, and a lower position, in which the sucked-on edge strip is bent away from the spacers (11), and furthermore has a conveyor belt (35) with grippers (37) which seize the edge strip (R') held by the suction heads (31) in their lower position.

12. Sheet-feeder according to claim 11, characterized in that the endless belt (18) is temporarily at a standstill in the transfer position and, in this position, the suction heads (31) are located underneath spacers (11).

13. Sheet-feeder according to claim 1, characterized in that, on passing the edge strip (R), each separating element (1) slides with an outer side (7), on which there open out channels (10) in connection with the suction openings (9), along a suction bar (41) having a longitudinal opening (43), connected to a suction-air source, which bar is fitted along the front region of the edge strip (R), in the direction of movement of the endless belt, and has a length which in each case takes up only a portion of the suction openings (9).

14. Sheet-feeder according to claim 1, characterized in that fitted underneath the sheet stack (S), along the end region of the edge strip neighboring the base (26) of the magazine (24) is a roller (34), over which the lowermost sheet rolls off during transporting away.

15. Sheet-feeder according to claim 1, characterized in that the resting surfaces (14) of the spacers (11) and the flat surface sections (5*a*) of the suction surfaces (5) of the separating elements (1) are inclined upward in relation to the plane of the base (26) of the magazine (24), so that the edge strips of the sheet stack (S) located in the magazine are bent obliquely upward, so that a sheet (W) assumes a flat position in the transfer position.

16. Sheet-feeder according to claim 5, wherein said maximum angle of inclination is between 15° and 25°.

17. Sheet-feeder according to claim 7, wherein said distance between the separating element (1) and the following spacer (11) is less than half of the length of the suction surface (5).

18. Sheet-feeder according to claim 13, wherein said suction bar (41) has a length which takes up 2 to 5 out of a total of 6 to 12 suction openings.

19. Sheet-feeder according to claim 15, wherein an angle of inclination of said edge strips of the sheet stack (S) located in the magazine is equal to the maximum angle of inclination of the suction surface (5) of a separating element (1).

* * * * *